US008204392B2

(12) United States Patent
Okano

(10) Patent No.: US 8,204,392 B2
(45) Date of Patent: Jun. 19, 2012

(54) IMAGE FORMING DEVICE

(75) Inventor: Tetsuya Okano, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 12/816,702

(22) Filed: Jun. 16, 2010

(65) Prior Publication Data

US 2011/0026946 A1 Feb. 3, 2011

(30) Foreign Application Priority Data

Jul. 31, 2009 (JP) ..... 2009-179217

(51) Int. Cl.
*G03G 15/08* (2006.01)

(52) U.S. Cl. ..... 399/27; 399/34; 399/46; 399/71

(58) Field of Classification Search ..... 399/9, 24, 399/27, 30, 34, 35, 38, 46, 61, 64, 71, 75, 399/343, 358, 360
See application file for complete search history.

(56) References Cited

U.S. PATENT DOCUMENTS

| | | | | |
|---|---|---|---|---|
| 5,710,956 | A * | 1/1998 | Kurohata et al. | 399/24 |
| 2005/0089338 | A1 * | 4/2005 | Hoshi et al. | 399/27 |
| 2008/0292357 | A1 | 11/2008 | Taguchi et al. | |

FOREIGN PATENT DOCUMENTS

| | | |
|---|---|---|
| JP | 11-194662 | 7/1999 |
| JP | 2001-324859 | 11/2001 |
| JP | 2003-91176 | 3/2003 |
| JP | 2005-257946 | 9/2005 |
| JP | 2006-11135 | 1/2006 |
| JP | 2008-250210 | 10/2008 |

* cited by examiner

*Primary Examiner* — David Porta
*Assistant Examiner* — Benjamin Schmitt
(74) *Attorney, Agent, or Firm* — Scully, Scott, Murphy & Presser, P.C.

(57) ABSTRACT

An image forming device includes a controller that is configured to, during a warming-up operation performed before an image forming operation, control a cleaner perfoiiiing cleaning to remove development agent from a conveying belt and a remaining amount detector performing detection of an amount of development agent remaining in the development unit in a contact state where a development unit contacts an image holding body. When it is presumed that there is a small amount of development agent on the image holding body, the controller controls the remaining amount detector to perform the detection during the cleaning. When it is presumed that there is a large amount of development agent on the image holding body, the controller controls the remaining amount detector to perform the detection after execution of the cleaning in a separate state where the development unit is apart from the image holding body.

5 Claims, 9 Drawing Sheets

FIG.2A
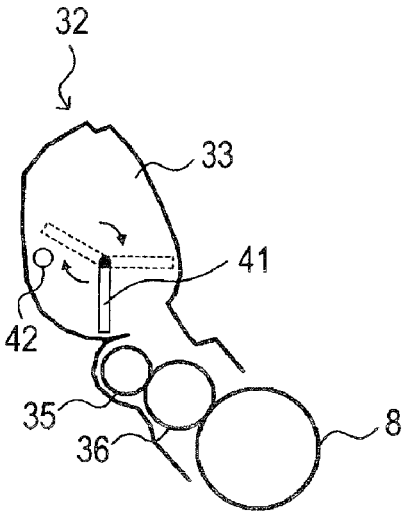
FIG.2B
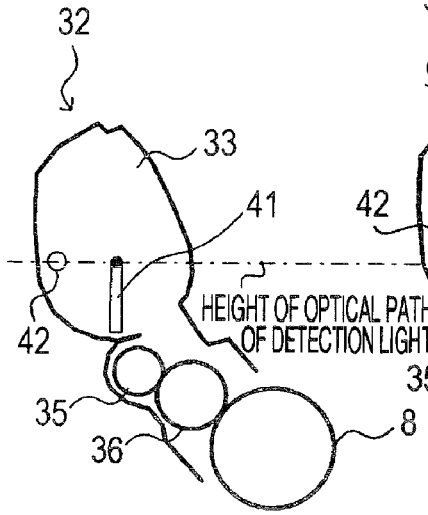
FIG.2C
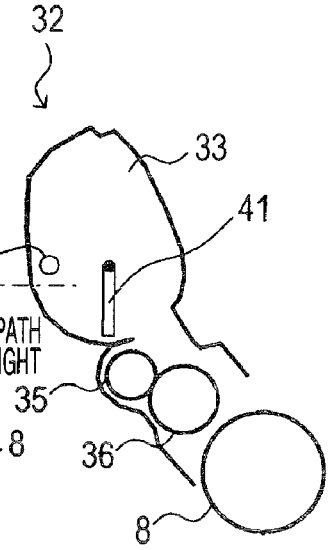
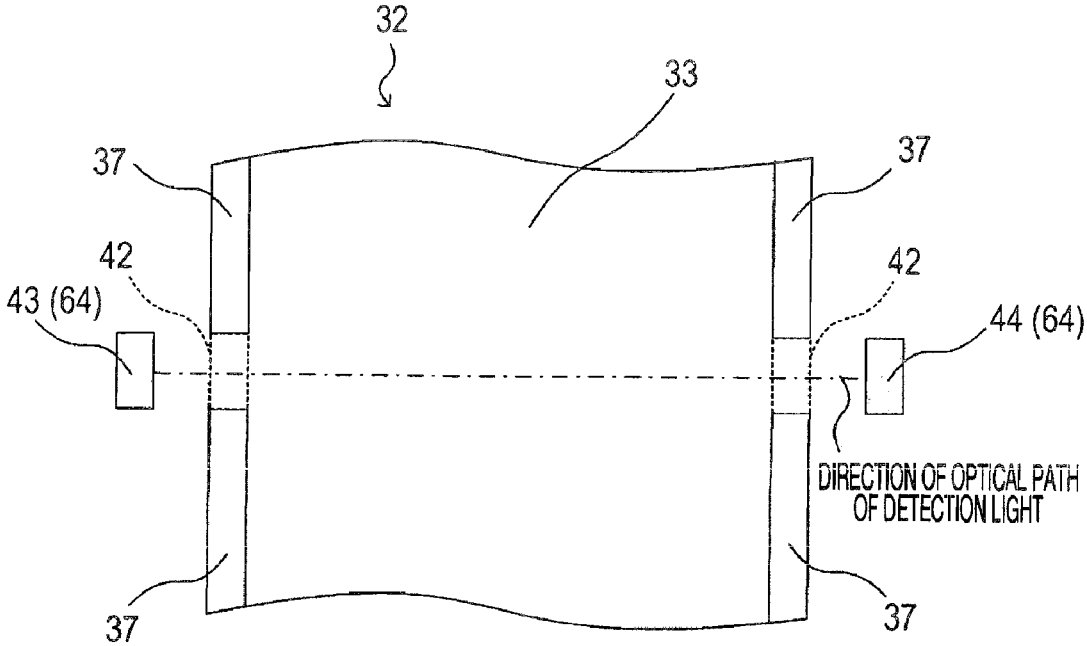
FIG. 3

IMAGE FORMING DEVICE

CROSS-REFERENCE TO RELATED APPLICATION

This application claims priority under 35 U.S.C. §119 from Japanese Patent Application No. 2009-179217 filed on Jul. 31, 2009. The entire subject matter of the application is incorporated herein by reference.

BACKGROUND

1. Technical Field

The following description relates to one or more image forming devices configured to perform a cleaning operation and an operation of detecting a remaining toner amount in execution of warming-up.

2. Related Art

An image forming device has been known, which includes a plurality of photoconductive bodies such as photoconductive drums that are disposed to face a conveying belt, a plurality of development devices each of which is configured to get into contact with and apart from a corresponding one of the photoconductive bodies, and a plurality of transfer devices each of which is disposed to contact the conveying belt so as to face a corresponding one of the photoconductive bodies across the conveying belt. It is noted that each development device is configured to accommodate development agent (toner) of a corresponding one of colors, black, cyan, yellow, and magenta.

Further, the image forming device is configured to, in execution of warming-up implemented before an image forming operation, perform a cleaning operation to transfer, onto the conveying belt, toner adhering onto the photoconductive bodies and remove the toner (waste toner) from the conveying belt. It is noted that in the cleaning operation, the waste toner on the conveying belt is generally collected into a waste toner box that is disposed in a position adjacent to the conveying belt and away from the photoconductive bodies.

Further, in a warming-up operation, an operation of detecting the amount of toner remaining in each development device is performed as well as the cleaning operation. It is noted that the image forming device is required to detect the remaining toner amount at a predetermined moment during the image forming operation (e.g., during a continuous printing operation) as well. Hence, the image forming device is configured to perform the operation of detecting the remaining toner amount in a state (a contact state) where each development device contacts a corresponding one of the photoconductive bodies.

SUMMARY

The known image forming device is configured to separately perform the cleaning operation and the operation of detecting the remaining toner amount. However, such a configuration for the image forming device has a problem that it takes much time to perform each warming-up operation. As one of possible solutions for the problem of the known image forming device, it is considered to reduce the time taken for the warming-up operation by executing the cleaning operation concurrently with the operation of detecting the remaining toner amount. Nonetheless, when such a manner is always implemented, it results in an undesirable situation that a different color of toner might be mixed into toner stored in each development device. This is because when a large amount of toner adhering to a photoconductive body is transferred onto the conveying belt in the contact state in the cleaning operation, some toner transferred might move onto a different photoconductive body via the conveying belt. Thus, the development device which contacts the different photoconductive body might be contaminated by an unconformable color of waste toner.

Aspects of the present invention are advantageous to provide one or more improved techniques for an image forming device that make it possible to perform a warming-up operation in an efficient and preferable manner.

According to aspects of the present invention, an image forming device is provided, which includes an image forming unit that includes a conveying belt, an image holding body disposed to face the conveying belt, a development unit configured to be set in any of a contact state where the development unit contacts the image holding body and a separate state where the development unit is apart from the image holding body, and a transfer unit disposed to contact the conveying belt so as to face the image holding body across the conveying belt, the transfer unit being configured to transfer, onto the conveying belt, development agent held on the image holding body. The image forming device further includes a cleaner configured to perform cleaning to remove the development agent that is transferred from the image holding body onto the conveying belt, a remaining amount detector configured to, in the contact state where the development unit contacts the image holding body, perform detection of an amount of development agent remaining in the development unit, a status identifying unit configured to identify a status of development agent on the image holding body between a first status where it is presumed that there is a small amount of development agent on the image holding body and a second status where it is presumed that there is a large amount of development agent on the image holding body, and a controller configured to control the cleaner and the remaining amount detector during a warming-up operation performed before an image forming operation by the image forming unit. When the status identifying unit identifies the status of development agent on the image holding body as the first status, the controller controls the remaining amount detector to perform the detection in execution of the cleaning by the cleaner. When the status identifying unit identifies the status of development agent on the image holding body as the second status, the controller controls the remaining amount detector to perform the detection, after execution of the cleaning by the cleaner in the separate state where the development unit is apart from the image holding body.

BRIEF DESCRIPTION OF THE ACCOMPANYING DRAWINGS

FIGS. 2A to 2C are cross-sectional side views partially showing a configuration of a development device in the embodiment according to one or more aspects of the present invention.

FIG. 3 is a partial cross-sectional view of the development device when viewed in a front-to-rear direction of the image forming device in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described with reference to the accompany drawings.

Overall Configuration

Figure 1:
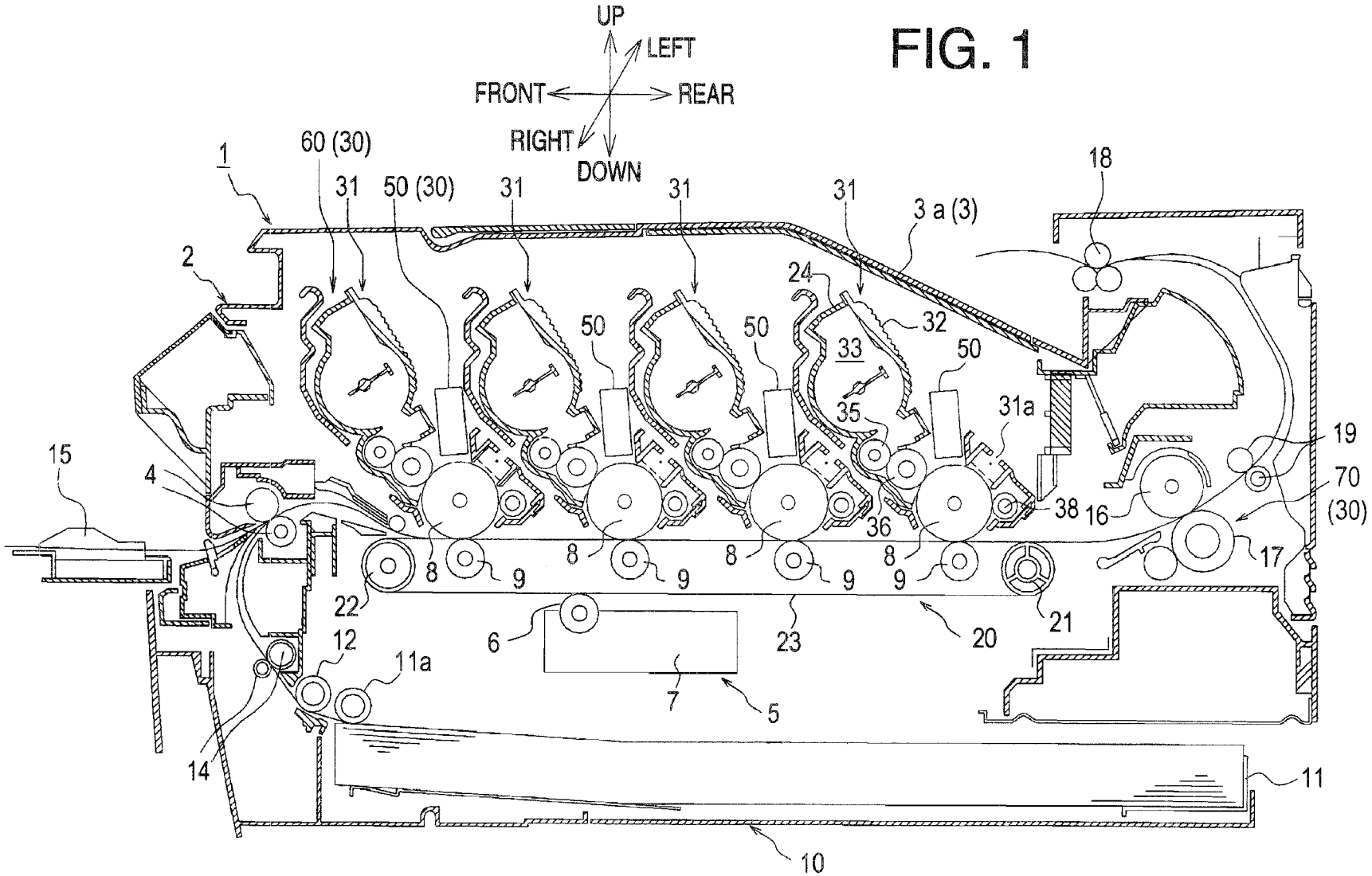
FIG. 1 is a cross-sectional side view schematically showing a configuration of an image forming device in an embodiment according to one or more aspects of the present invention.

In the following description, each of front, rear, left, right, up, and down sides will be defined as depicted in FIG. 1.

As shown in FIG. 1, an image forming device 1, which is a direct-transfer tandem type color image forming device, includes a substantially box-shaped housing 2. On an upper face of the housing 2, a catch tray 3*a* is formed, on which a recording sheet (hereinafter, which may simply be referred to as a sheet) with an image formed thereon is placed. Further, the image forming device 1 includes a top cover 3 formed integrally with the catch tray 3*a*. The top cover 3 is configured to cover the upside of the image forming device 1 and to be openable and closable around an upper rear end of the image forming device 1. When the top cover 3 is opened, below-mentioned image forming units 31 can be detached upward from the inside of the housing 2.

Further, the image forming device 1 includes, inside the housing 2, a feeder unit 10 for supplying a recording sheet, an image forming section 30 configured to perform an image forming operation on the recording sheet supplied from the feeder unit 10, and a controller 40 (see FIG. 4) configured to take control to drive the aforementioned units.

The feeder unit 10 includes a feed tray 11 on which recording sheets are stacked, a feed roller 11*a* that is disposed above a front end of the feed tray 11 and configured to feed sheets, a separation roller 12 configured to pick up a sheet from the feed tray 11, a pair of pitch rollers 14 configured to convey the sheet fed by the separation roller 12 to a conveying mechanism 20, a pair of registration rollers 4 disposed above the pitch rollers 14 (and behind a manual feed tray 15), and the manual feed tray 15 for directly feeding a sheet from a front face of the housing 2.

Further, the conveying mechanism 20 is incorporated inside the housing 2. The conveying mechanism 20 includes a driving roller 21 configured to rotate in conjunction with operations of the image forming section 30, a driven roller 22 rotatably provided in a position away from the driving roller 21, and a conveying belt 23 hung around both the driving roller 21 and the driven roller 22.

The conveying belt 23 is driven by the driving roller 21 so as to turn in a clockwise direction shown in FIG. 1, and configured to feed backward a sheet placed thereon. In addition, there is under the conveying belt 23, a belt cleaning unit 5 configured to remove material such as development agent (hereinafter referred to as toner) adhering to the conveying belt 23.

The belt cleaning unit 5 is disposed in contact with the conveying belt 23. Further, the belt cleaning unit 5 includes a roller-shaped belt cleaner 6 configured to, when a predetermined voltage is applied thereto, collect material on the conveying belt 23, and a waste toner box 7 for storing the material (especially, waste toner) collected by the belt cleaner 6.

Configuration of Image Forming Section

The image forming section 30 includes the aforementioned conveying belt 23 (the conveying mechanism 20), LED units 50 for forming an electrostatic latent image on an outer circumferential surface of each photoconductive drum 8, a process unit 60 configured to develop the electrostatic latent images formed by the LED units 50 with toner and to transfer the developed images (toner images) onto a sheet conveyed by the conveying mechanism 20, and a fixing unit 70 configured to fix the image(s) transferred by the process unit 60.

The process unit 60 includes a plurality of image forming units 31 (in the embodiment, four image forming units 31), a plurality of transfer rollers 9 (in the embodiment, four transfer rollers 9) configured to respectively press a sheet against the photoconductive drums 8 of the image forming units 31, and roller-shaped OPC cleaners 38 each of which is provided for a corresponding one of the photoconductive drums 8.

Each transfer roller 9 is provided for a corresponding one of the photoconductive drums 8, and disposed in contact with the conveying belt 23 so as to face the corresponding photoconductive drum 8 across the conveying belt 23. When a predetermined voltage (hereinafter, which may be referred to as a transfer bias voltage), which is required for transferring, onto a sheet or the conveying belt 23, the toner adhering onto the outer circumferential surface of the photoconductive drum 8, is applied between the transfer roller 9 and the photoconductive drum 8, a predetermined transfer current is carried therebetween.

Each OPC cleaner 38 is disposed behind a corresponding one of photoconductive drums 8 so as to contact the corresponding photoconductive drum 8. The OPC cleaner 38 is configured to collect toner remaining on the outer circumferential surface of the corresponding photoconductive drum 8 and to return the collected toner onto the outer circumferential surface of the corresponding photoconductive drum 8 at a predetermined moment. It is noted that the OPC cleaner 38 is configured to, when a predetermined negative voltage (e.g., −400V) is applied thereto, collect the toner from the photoconductive drum 8. Further, when a predetermined positive voltage (e.g., +400V) is applied, the OPC cleaner 38 returns the collected toner to the photoconductive drum 8.

Each image forming unit 31 includes a corresponding one of the photoconductive drums 8 respectively disposed along a conveying direction (in which a sheet is conveyed on the conveying belt 23) so as to face the conveying belt 23, an electrification device 31*a* configured to electrostatically charge the corresponding photoconductive drum 8, and a development device 32 configured to be brought into contact with and apart from the corresponding photoconductive drum 8. It is noted that in the embodiment, each photoconductive drum 8 is disposed to contact the conveying belt 23 and rotate in conjunction with the movement of the conveying belt 23.

Each electrification device 31*a* is disposed at an obliquely upper side behind the photoconductive drum 8, so as to face the photoconductive drum 8 a predetermined distance away from the photoconductive drum 8. Further, the electrification device 31*a* is configured to electrostatically-charge the outer circumferential surface of the photoconductive drum 8 positively and evenly, by generating a corona discharge when a predetermined voltage is applied.

Each development device 32 includes a toner container 33 configured to accommodate toner, a supply roller 35 configured to supply the toner from the toner container 33 to a development roller 36, the development roller 36 that is disposed to contact the supply roller 35 and configured to develop the electrostatic latent image on the photoconductive drum 8 with the toner supplied from the supply roller 35, and the aforementioned roller-shaped OPC cleaner 38. The development roller 36 is configured to rotate in conjunction with the photoconductive drum 8 while contacting the photoconductive drum 8.

The toner containers 33 store toner (specifically, positively-chargeable nonmagnetic one-component toner) of respective colors (black K, yellow Y, magenta M, and cyan C in the order from an upstream side in the conveying direction of the conveying belt 23) that differ from a cartridge 24 to another.

Further, as illustrated in FIG. 2A, each development device 32 includes an agitator 41 configured to agitate the toner stored in the toner container 33, and two toner detection windows 42 for detecting the amount of remaining toner that are provided in an outer wall 37 (see FIG. 3) of the toner container 33. It is noted that the agitator 41 is configured to rotate in conjunction with the development roller 36.

The toner detection windows 42 are formed from optically transparent material. The toner detection windows 42 are disposed to face each other across the toner container 33 in a width direction (i.e., in the left-to-right direction in FIG. 1). Further, as depicted in FIG. 2B, in a state (hereinafter referred to as a contact state) where the development device 32 contacts the photoconductive drum 8, the toner detection window 42 are placed on an optical path of detection light emitted by a toner sensor 64 (see FIG. 3). Additionally, as shown in FIG. 2C, each toner detection window 42 is formed in such a size as to be out of the optical path of detection light in a state (hereinafter referred to as a separate state) where the development device 32 is apart from the photoconductive drum 8.

As depicted in FIG. 3, each toner sensor 64 includes a light emitter 43 that emits detection light toward one of the toner detection windows 42 from the outside, and a light receiver 44 that receives the detection light transmitted through the toner detection windows 42. Further, the toner sensor 64 is configured to issue a detection signal to the controller 40 (see FIG. 4) each time the light receiver 44 detects the detection light.

Referring back to FIG. 1, each LED unit 50 is configured, in a known manner, to perform an exposure operation using LEDs (not shown). Specifically, each LED unit 50 is configured to, in response to receipt of image data and a control command from the controller 40 (see FIG. 4), perform high-speed scanning on a corresponding one of the photoconductive drums 8 with the LEDs of a corresponding color, at timing and an exposure speed that are defined by the control command.

The fixing unit 70 includes a heating roller 16 that feeds a sheet while heating toner transferred onto the sheet, and a pressing roller 17 that is disposed to face the heating roller 16 across the sheet and configured to press the sheet against the heating roller 16. Thus, the fixing unit 70 is configured to heat, melt, and fix the toner transferred onto the sheet. It is noted that the sheet, after passing through the fixing unit 70, is further fed by feed rollers 19, and then ejected onto the catch tray 3*a* via one or more ejections rollers 18.

Namely, the image forming section 30 is configured to transfer toner images, which are respectively formed on the photoconductive drums 8 through exposure with LED light emitted by the LED units 50 and development by the image forming units 31, onto the sheet being fed by the conveying mechanism 20 from the feeder unit and passing through the process unit 60. Further, the image forming section 30 is configured to fix the toner images transferred onto the sheet when the sheet is passing through the fixing unit 70.

Controller

Figure 4:
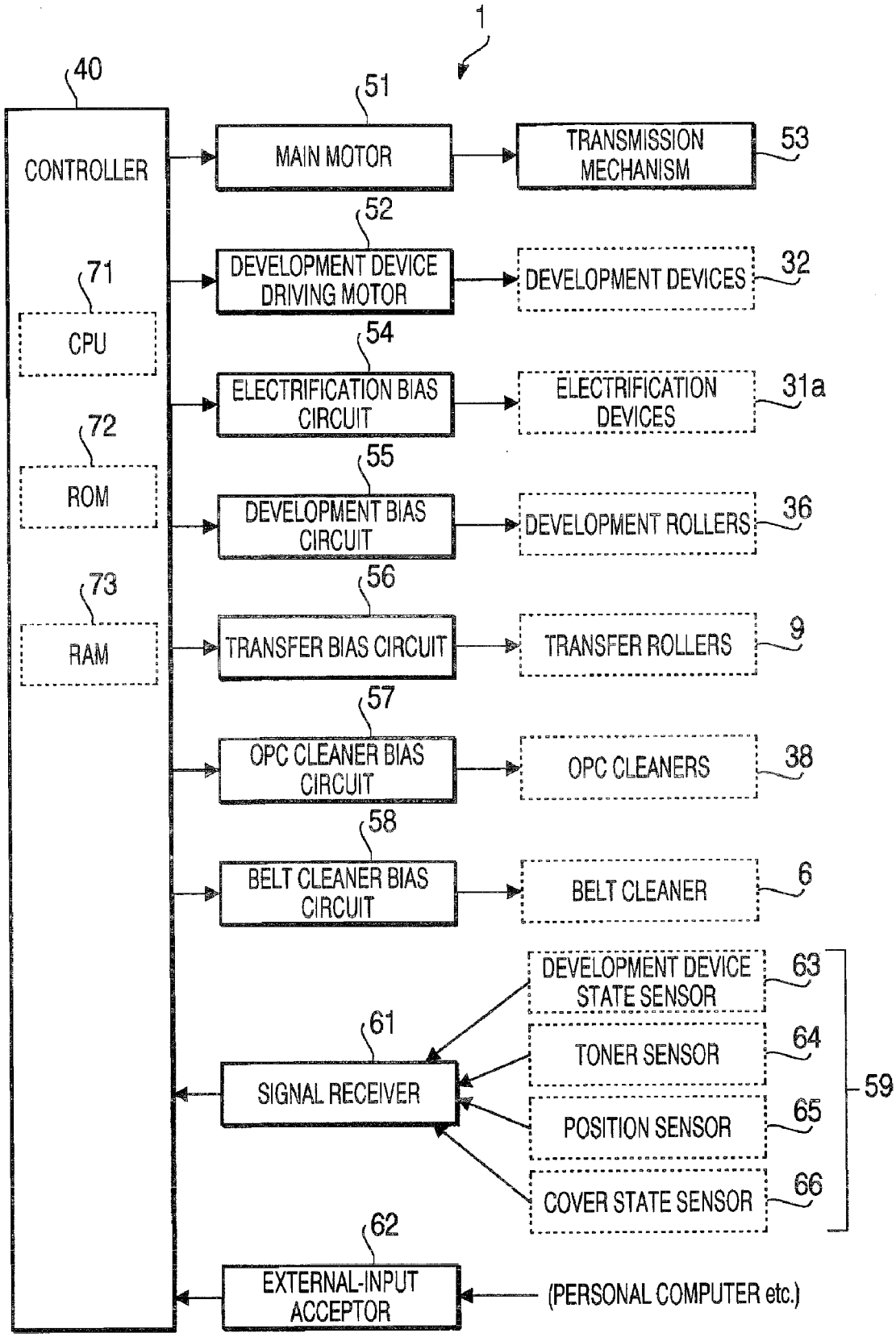
FIG. 4 is a block diagram partially showing an electrical configuration of the image forming device in the embodiment according to one or more aspects of the present invention.

As shown in FIG. 4, the controller 40 is configured to control a main motor 51, a development device driving motor 52, and a transmission mechanism 53. It is noted that the main motor 51 is a driving source of the image forming device 1. In addition, the development device driving motor 52 is configured to move each development device 32 relative to a corresponding one of the photoconductive drums 8 so as to switch the state of the development device 32 between the contact state and the separate state. Further, the transmission mechanism 53 is configured to transmit a driving force from the main motor 51 to driving shafts of various rollers provided to the image forming device 1 and controls intermittence and shift transmission of the driving force.

Further, the controller 40 is connected with an electrification bias circuit 54, a development bias circuit 55, a transfer bias circuit 56, an OPC cleaner bias circuit 57, and a belt cleaner bias circuit 58. The electrification bias circuit 54, the development bias circuit 55, the transfer bias circuit 56, the OPC cleaner bias circuit 57, and the belt cleaner bias circuit 58 are configured to control voltages applied to each electrification device 31*a*, each development roller 36, each transfer roller 9, each OPC cleaner 38, and the belt cleaner 6, respectively.

Further, the controller 40 is connected with a signal receiver 61 and an external-input acceptor 62. The signal receiver 61 is configured to receive detection signals from a sensor group 59 of sensors disposed in various positions of the image forming device 1. The external-input acceptor 62 is configured to accept external inputs such as a user command and image data transmitted by an external device (e.g., a personal computer). It is noted that the sensor group 59 contains a development device state sensor 63 configured to detect the state (i.e., the contact state or the separate state) of the development devices 32, a position sensor 65 configured to detect a position of a sheet inside the housing 2, a cover state sensor 66 configured to detect a state (i.e., an opened state or a closed state) of the top cover 3, and the aforementioned toner sensor 64.

The controller 40 is configured with a known microcomputer that includes a CPU 71, a ROM 72, a RAM 73, and a bus line via which the aforementioned elements are interconnected. Based on programs stored on the ROM 72, the CPU 71 executes a cover monitoring process, an image forming process, and a warming-up process, which processes will be described in detail below. The RAM 73 of the embodiment is configured as a non-volatile memory, on which a flag memory area is secured to store a status flag that represents a status (a toner adhering status) of toner adhering onto the photoconductive drums 8. The CPU 71 resets (clears) the status flag when presuming that there is a small amount of toner adhering to the photoconductive drums 8, the conveying belt 23, and the OPC cleaners 38 (the toner adhering status: a first status). Meanwhile, the CPU 71 sets the status flag when presuming that there is a large amount of toner adhering to the photoconductive drums 8, the conveying belt 23, and the OPC cleaners 38 (the toner adhering status: a second status).

Cover Monitoring Process

A cover monitoring process will be described with reference to FIG. 5. The cover monitoring process is launched when the image forming device 1 is powered on, and repeatedly executed until the image forming device 1 is powered off.

Figure 5:
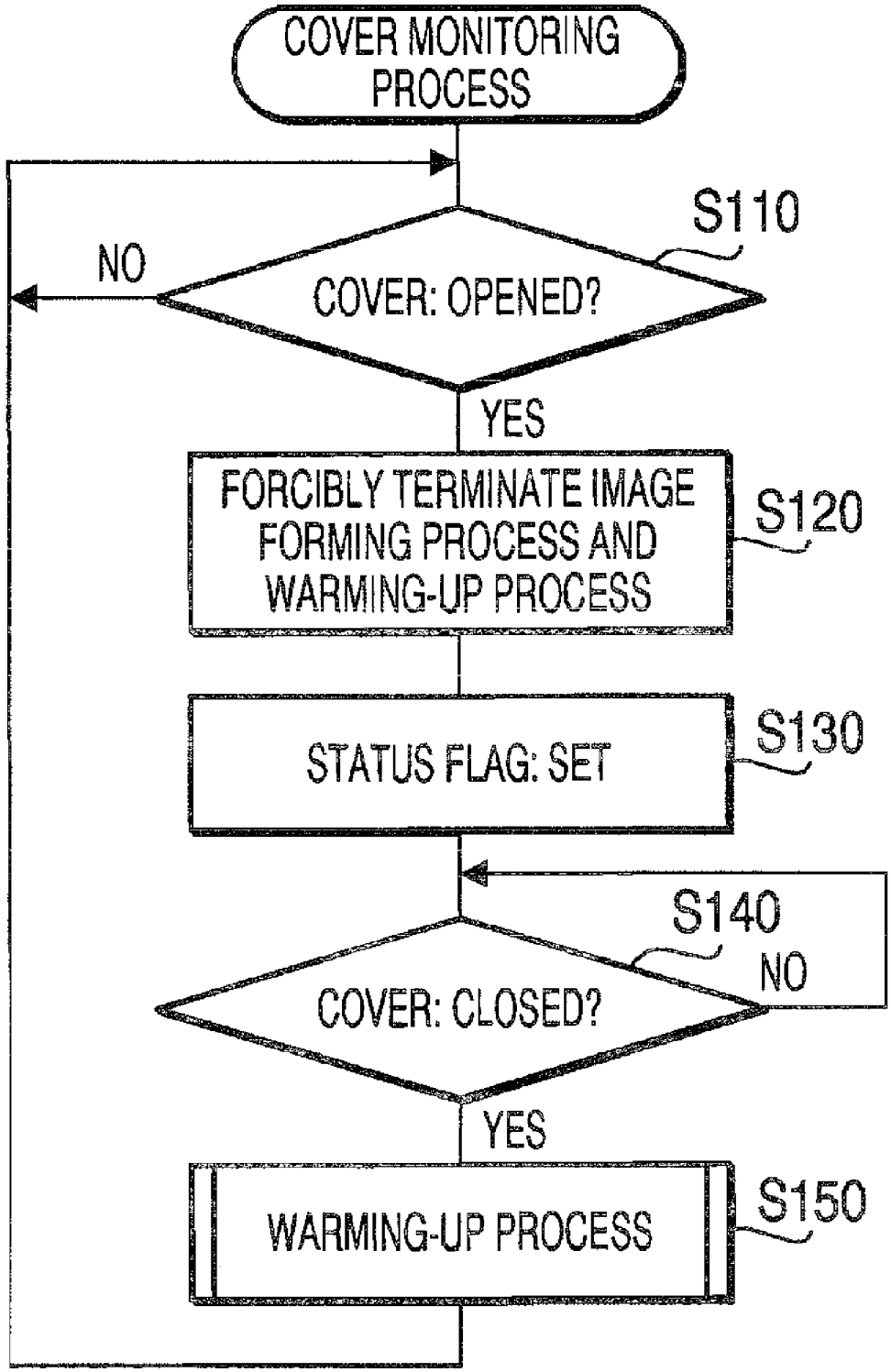
FIG. 5 is a flowchart showing a detailed procedure of a cover monitoring process to be executed by a CPU of a controller in the embodiment according to one or more aspects of the present invention.

As shown in FIG. 5, when the cover monitoring process is launched, the CPU 71 first determines, based on a detection result by the cover state sensor 66, whether the top cover 3 is opened (S110). When determining that the top cover 3 is opened (S110: Yes), the CPU 71 goes to S120. Meanwhile, when determining that the top cover 3 is not opened (S110: No), the CPU 71 repeatedly performs the step S110.

In S120, the CPU 71 forcibly terminates the below-mentioned image forming process and warming-up process (S120). Subsequently, in S130, the CPU 71 sets the status flag by storing the status flag in association with the second status into the flag memory area secured on the RAM 73 (S130).

Specifically, when the top cover 3 is opened, one or more photoconductive drums 8 and/or the conveying belt 23 may be replaced by the user. At the time of such replacement, the photoconductive drums 8 and/or the conveying belt 23 is likely to be contaminated by waste toner. Therefore, the CPU 71 sets the status flag to the second status where it is presumed that there is a large amount of waste toner on the photoconductive drums 8 and the conveying belt 23.

In a subsequent step S140, the CPU 71 determines, based on a detection result of the cover state sensor 66, whether the top cover 3 is closed (S140). When determining that the top cover 3 is closed (S140: Yes), the CPU 71 goes to S150. Meanwhile, when determining that the top cover 3 is not closed (S140: No), the CPU 71 repeatedly executes the step S140.

In S150, the CPU 71 launches the below-mentioned warming-up process (S150), and then goes to S110.

Image Forming Process

Figure 6:
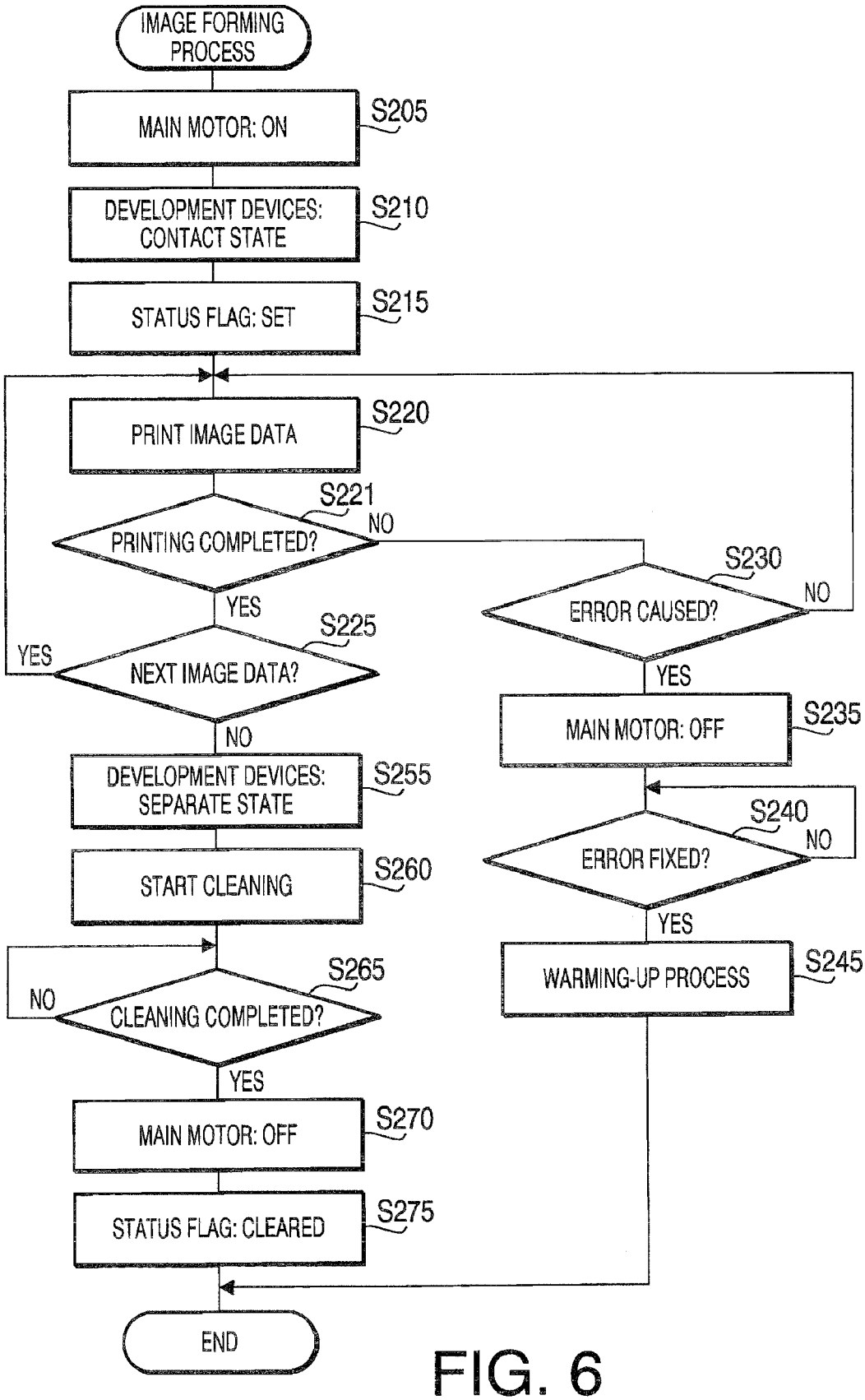
FIG. 6 is a flowchart showing a detailed procedure of an image forming process to be executed by the CPU of the controller in the embodiment according to one or more aspects of the present invention.

The image forming process as shown in FIG. 6 is launched when a print request is accepted via the external-input acceptor 62 from an external device in a standby state S2 (see FIG. 10) where the image forming unit 30 is ready to perform an image forming operation.

As illustrated in FIG. 6, when the image forming process is launched, the CPU 71 sets the main motor 51 on (S205). Subsequently, the CPU 71 sets the development devices 32 to the contact state (S210), and then goes to S215. Specifically, in S210, when determining that the development devices are in the separate state based on a detection result of the development device state sensor 63, the CPU 71 controls the development device driving motor 52 to move each development device 32 to such a position as to contact a corresponding one of the photoconductive drums 8.

Next, the CPU 71 sets the status flag (to the second status) in the flag memory area on the RAM 73 (S215), and then advances to S220. In S220, the CPU 71 controls the image forming unit 30 to form an image on a sheet in a known manner in accordance with image data to be printed based on the print request (S220). Additionally, the CPU 71 controls the OPC cleaner bias circuit 57 to apply a predetermined negative voltage to the OPC cleaners 38, such that the OPC cleaners 38 collect toner remaining on the outer circumferential surfaces of the photoconductive drums 8. At that time, owing to the image forming operation executed in a known manner by the image forming unit 30, a large amount of toner is likely to stay on the photoconductive drums 8 or the OPC cleaners 38. Therefore, before executing S220, in S215, the CPU 71 sets the status flag in the flag memory area on the RAM 73 to the second status where there is a large amount of toner remaining on the photoconductive drums 8 or the OPC cleaners 38.

Subsequently, in S221, the CPU 71 determines whether the operation of printing the image data in S220 is completely performed (S221). When determining that the operation of printing the image data in S220 is completely performed (S221: Yes), the CPU 71 goes to S225. Meanwhile, when determining that the operation of printing the image data in S220 is not completely performed (S221: No), the CPU 71 goes to S230.

In S225, the CPU 71 determines whether image data remains in a receipt buffer (namely, whether there is image data to be subsequently printed) (S225). When determining that image data remains in the receipt buffer (S225: Yes), the CPU 71 goes to S255. Meanwhile, when determining that image data does not remain in the receipt buffer (S225: No), the CPU 71 goes to S220.

In S230, the CPU 71 determines whether there is any error caused during the operation of printing the image data in S220. The CPU 71 uses detection result of the position sensor 65 or the cover state sensor 66 or any other sensors for the determination. When determining that there is any error caused (S230: Yes), the CPU 71 goes to S235. Meanwhile, when determining that there is not any error caused (S230: No), the CPU 71 goes to S220.

It is noted that the error includes a paper jam inside the housing 2, the opened state of the top cover 3, and emergency stop of an image forming operation by the image forming unit 30 due to malfunction of the main motor 51 that might be caused in the image forming operation.

In S235, the CPU 71 sets the main motor 51 off (S235). In a subsequent step S240, the CPU 71 determines whether the error such as a paper jam is settled (S240). When determining that the error is settled (S240: Yes), the CPU 71 goes to S245. Meanwhile, when determining that the error is not settled (S240: No), the CPU 71 repeatedly executes S240.

In S245, the CPU 71 performs the below-mentioned warming-up process (S245), and then terminates the image forming process. In S255, the CPU 71 sets each development device 32 to the separate state through control of the development device driving motor 52 (S255). In a subsequent step S260, the CPU 71 performs a cleaning operation to remove material adhering onto the conveying belt 23 (S260), and thereafter goes to S265. It is noted that in S260, after starting the cleaning operation, the CPU 71 applies a predetermined positive voltage to each OPC cleaners 38 via the OPC cleaner bias circuit 57 so as to return the toner collected in S220 onto the outer circumferential surfaces of the photoconductive drums 8. Further, the CPU 71 applies a transfer bias to each transfer roller 9 via the transfer bias circuit 56 so as to transfer the toner from the photoconductive drums 8 onto the conveying belt 23. Then, the CPU 71 applies a predetermined voltage to the belt cleaner 6 via the belt cleaner bias circuit 58 so as to collect, into the waste toner box 7, the adhering material which contains waste toner transferred onto the conveying belt 23 from the photoconductive drums 8.

In S265, the CPU 71 determines whether the cleaning operation has been completed (S265). When determining that the cleaning operation has been completed (S265: Yes), the CPU 71 goes to S270. Meanwhile, when determining that the cleaning operation has not been completed (S265: No), the CPU 71 waits for the cleaning operation to be completely executed.

In S270, the CPU 71 turns off the main motor 51 (S270). At the moment to execute S275, the cleaning operation has already been completed, and therefore it is presumed that there is only a small amount of toner remaining on the photoconductive drums 8 and the conveying belt 23.

Thus, in S275, the CPU 71 presumes that that there is a small amount of toner adhering to the photoconductive drums 8, the conveying belt 23, and the OPC cleaners 38 (the toner adhering status: the first status), and clears the status flag from the flag memory area on the RAM 73 (S275). Thereafter, the CPU 71 terminates the image forming process.

Warming-Up Process

Next, a warming-up process will be described with reference to FIG. 7. The warming-up process is launched when the image forming device 1 is powered on, and also executed in S150 of the cover monitoring process and S245 of the image forming process.

Figure 7:
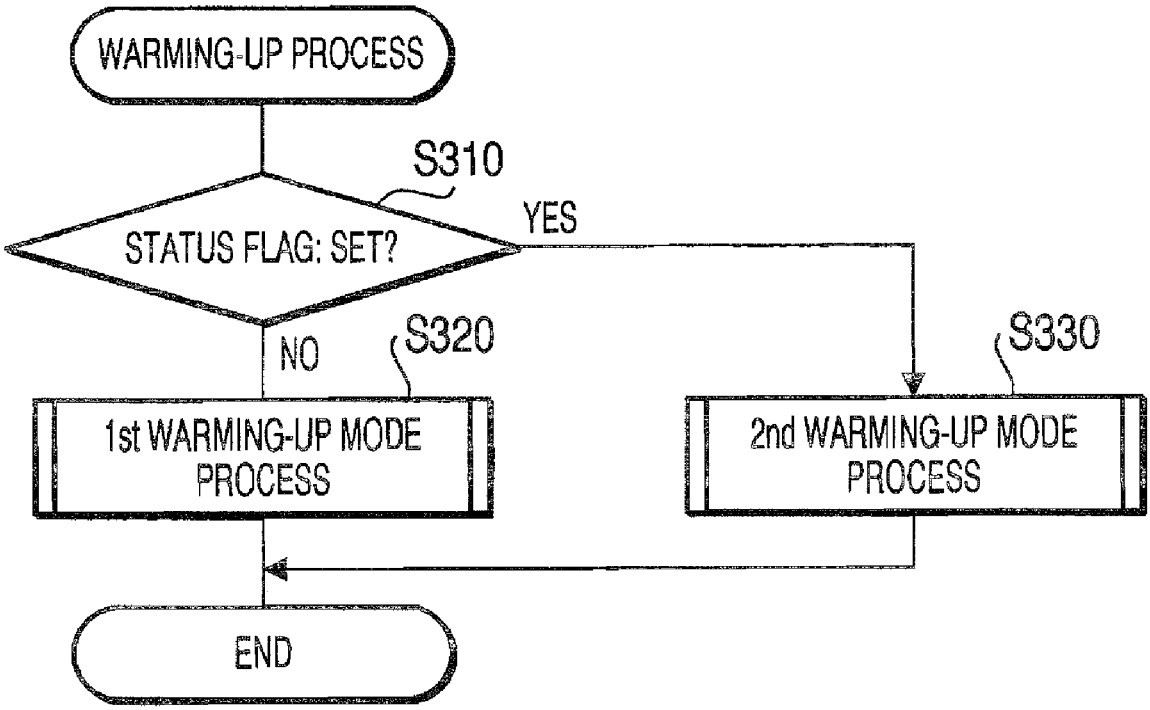
FIG. 7 is a flowchart showing a detailed procedure of a warming-up process to be executed by the CPU of the controller in the embodiment according to one or more aspects of the present invention.

As shown in FIG. 7, when the warming-up process is launched, the CPU 71 determines whether the status flag is set in the flag memory area on the RAM 73 (S310). When determining that the status flag is set in the flag memory area on the RAM 73 (S310: Yes), the CPU 71 goes to S330. Meanwhile, when determining that the status flag is not set in the flag memory area on the RAM 73 (S310: No), the CPU 71 goes to S320.

In S320, the CPU 71 performs a first warming-up mode process (S320). In the first warming-up mode process, a warming-up operation, in which the image forming unit 30 is set to a standby state, is executed in a first operation mode for the first status where there is a small amount of toner adhering onto the photoconductive drums 8. Thereafter, the CPU 71 terminates the warming-up process.

In S330, the CPU 71 performs a second warming-up mode process (S330). In the second warming-up mode process, the warming-up operation is executed in a second operation mode for the second status where there is a large amount of toner adhering onto the photoconductive drums 8. Thereafter, the CPU 71 terminates the warming-up process.

First Warming-Up Mode Process

Subsequently, a detailed explanation will be provided about the first warming-up mode process executed in S320 of the warming-up process, with reference to FIG. 8.

Figure 8:
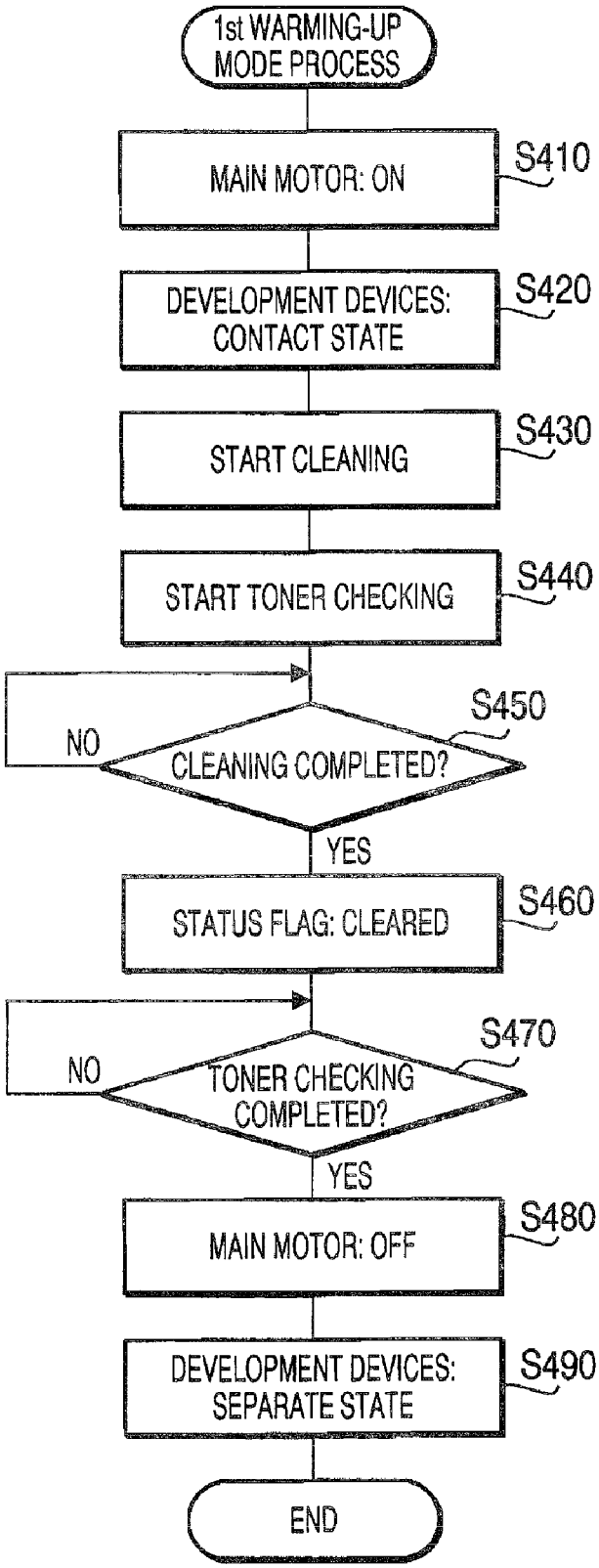
FIG. 8 is a flowchart showing a detailed procedure of a first warming-up mode process to be executed by the CPU of the controller in the embodiment according to one or more aspects of the present invention.

As shown in FIG. 8, when the first warming-up mode process is launched, the CPU 71 turns on the main motor 51 (S410). In a subsequent step S420, the CPU 71 sets each development device 32 to the contact state (S420), and then goes to S430. It is noted that in S420, the CPU 71 controls the development device driving motor 52 to move each development device 32 to such a position as to contact a corresponding one of the photoconductive drums 8, in the same manner as S210 of the aforementioned image forming process.

In S430, the CPU 71 performs a cleaning operation (S430). In a subsequent step S440, the CPU 71 performs a remaining amount detecting operation (hereinafter, which may be referred to as a toner checking operation) to operate the toner sensors 64 so as to detect an amount of toner remaining in the toner containers 33 (S440). It is noted that in S430, in the same manner as S260 of the aforementioned image forming process, material adhering to the conveying belt 23, which material contains waste toner transferred from the photoconductive drums 8 to the conveying belt 23, is collected into the waste toner box 7. Additionally, in S440, the remaining amount of toner is detected by measuring a light receiving frequency at which each light receiver 44 receives the detection light based on the detection signals that the signal receiver 61 receives from the toner sensors 64.

In a subsequent step S450, the CPU 71 determines whether the cleaning operation has completely been performed (S450). When determining that the cleaning operation has completely been performed (S450: Yes), the CPU 71 goes to S460. Meanwhile, when determining the cleaning operation has not completely been performed (S450: No), the CPU 71 waits for the cleaning operation to be completed.

In S460, the CPU 71 clears the status flag from the flag memory area on the RAM 73 (S460). In S470, the CPU 71 determines whether a predetermined time period has elapsed to measure the light receiving frequency at which each light receiver 44 receives the detection light, i.e., whether the toner checking operation has been completed (S470). When determining that the toner checking operation has been completed (S470: Yes), the CPU 71 goes to S480. Meanwhile, when determining that the toner checking operation has not been completed (S470: No), the CPU 71 waits for the toner checking operation to be completed.

In S480, the CPU 71 turns off the main motor 51 (S480). In a subsequent step S490, the CPU 71 controls the development device driving motor 52 to set each development device 32 to the separate state (S490). Thereafter, the CPU 71 terminates the first warming-up mode process.

Second Warming-Up Mode Process

Figure 9:
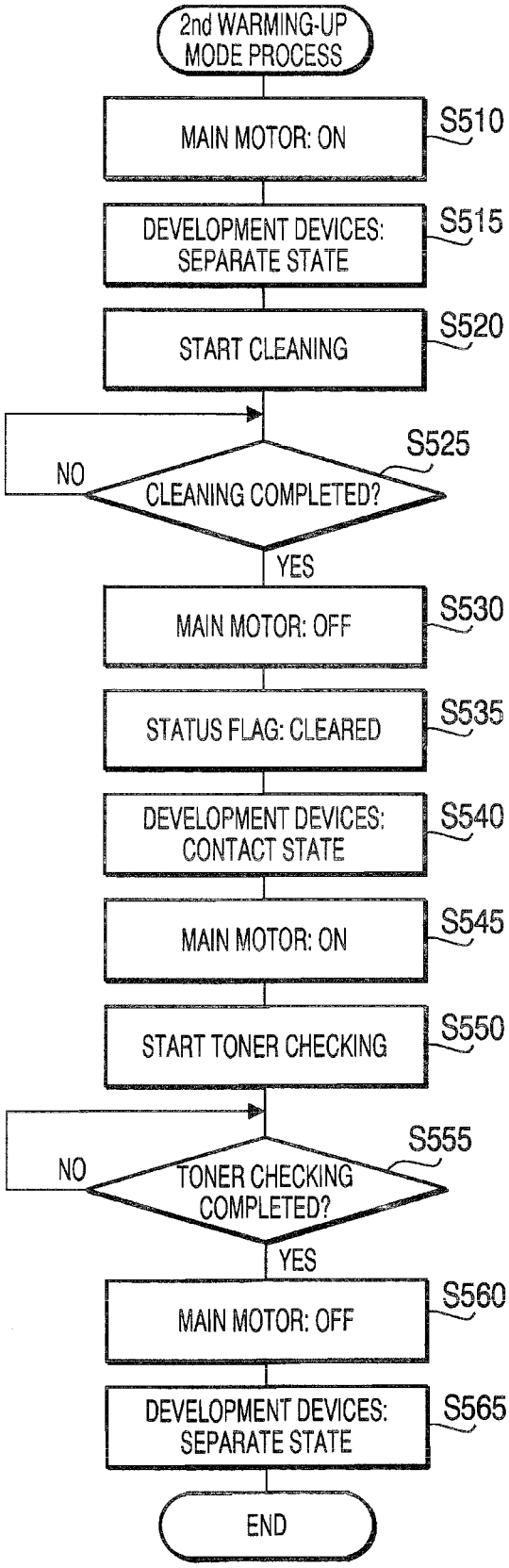
FIG. 9 is a flowchart showing a detailed procedure of a second warming-up mode process to be executed by the CPU of the controller in the embodiment according to one or more aspects of the present invention.

Next, a detailed explanation will be provided about a second warming-up mode process to be executed by the CPU 71 of the controller 40, with reference to FIG. 9. The second warming-up mode process is executed in S320 of the warming-up process.

As shown in FIG. 9, when the second warming-up mode is launched, the CPU 71 turns on the main motor 51 (S510). In a subsequent step S515, the CPU 71 sets each development device 32 to the separate state (S515), and thereafter goes to S520. It is noted that in S515, when determining that each development device 32 is set in the contact state, based on the detection result of the development device state sensor 63, the CPU 71 controls the development device driving motor 52 to move each development device 32 to such a position as to be apart from a corresponding one of the photoconductive drums 8.

In S520, the CPU 71 begins the cleaning operation (S520). In a subsequent step S525, the CPU 71 determines whether the cleaning operation has been completed (S525). When determining that the cleaning operation has been completed (S525: Yes), the CPU 71 goes to S530. Meanwhile, when determining that the cleaning operation has been completed (S525: Yes), the CPU 71 waits for the cleaning operation to be completed. It is noted that in S520, in the same manner as S260 of the aforementioned image forming process and S430 of the first warming-up mode process, material adhering to the conveying belt 23, which material contains waste toner transferred from the photoconductive drums 8 to the conveying belt 23, is collected into the waste toner box 7.

In S530, the CPU 71 turns off the main motor 51 (S530). In a subsequent step S535, the CPU 71 clears the status flag from the flag memory area on the RAM 73 (S535), and thereafter goes to S540. In S540, the CPU 71 controls the development device driving motor 52 to set each development device 32 to the contact state (S540). In a subsequent step S545, the CPU 71 turns on the main motor 51 (S545), and thereafter goes to S550.

In S550, the CPU 71 begins the toner checking operation (S550). In a subsequent step S555, the CPU 71 determines whether the toner checking operation has been completed (S555). When determining that the toner checking operation has been completed (S555: Yes), the CPU 71 goes to S560. Meanwhile, when determining that the toner checking operation has not been completed (S555: No), the CPU 71 waits for the toner checking operation to be completed. It is noted that in S550, in the same manner as S440 of the aforementioned first warming-up mode process, the CPU 71 detects the remaining amount of toner by measuring the light receiving frequency at which each light receiver 44 receives the detection light.

In S560, the CPU 71 turns off the main motor 51 (S560). In a subsequent step S565, the CPU 71 controls the development device driving motor 52 to set each development device 32 to the separate state (S565), and thereafter terminates the second warming-up mode process.

Operational States of Image Forming Device

Figure 10:
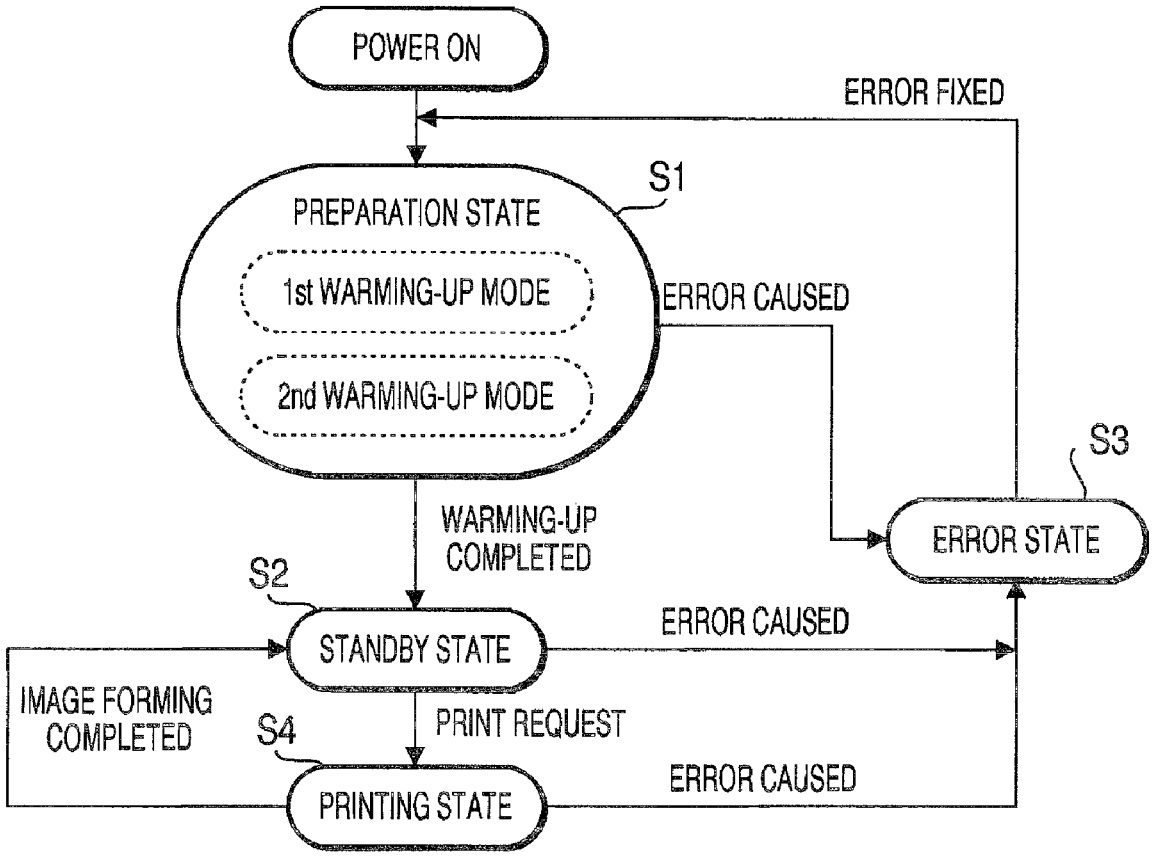
FIG. 10 is a diagram showing how the image forming device is transferred from one operational state to another in the embodiment according to one or more aspects of the present invention.

As illustrated in FIG. 10, when powered on, the image forming device 1 configured as above is set to a preparation state S1 where the warming-up operation is performed. When there is not an error (e.g., an urgent stop due to malfunction of the main motor 51, and the top cover 3 left opened) caused during the warming-up operation, the image forming device 1 is transferred from the preparation state S1 to a standby state S2 where an image forming operation is executable.

When an error, such as an urgent stop due to malfunction of the main motor 51 and the top cover 3 left opened, is caused in the preparation state S1 or the standby state S2, the cleaning operation or the toner checking operation is forcibly terminated, and the image forming device 1 is transferred from the preparation state S or the standby state S2 to an error state S3. When the error is fixed, the image forming device 1 is transferred from the error state to the preparation state S1.

When receiving a print request from an external device in the standby state S2, the image forming device 1 is set to a printing state S4 where an image forming operation is performed. When an error, such as an error that the top cover 3 is opened and a paper jam, is caused in the image forming operation, the image forming device 1 is transferred from the printing state S4 to the error state S3. Further, when the error is fixed, the image forming device 1 is transferred from the error state S3 to the preparation state S1. When no error is caused during the image forming operation, after the image forming operation, the image forming device 1 is transferred from the printing state S4 to the standby state S2.

The image forming device 1 performs the warming-up operation in the second warming-up mode, when powered off in the error state S3 and thereafter powered on and set to the preparation state S1, or when transferred directly to the preparation state S1 from the error state S3. Meanwhile, the image forming device 1 performs the warming-up operation in the first warming-up mode, when powered off in a non-error state (e.g., the standby state S2) and thereafter powered on and set to the preparation state S1.

Namely the image forming device 1 performs the warming-up operation in the second warming-up mode in the following cases. One is a case where a large amount of toner is presumed to remain on the photoconductive drums 8, e.g., when the image forming operation is forcibly terminated in execution, or a user forcibly pulls out a sheet to fix a paper jam. Further, another is a case where contamination such as dust is presumed to adhere onto the photoconductive drums 8 when the top cover 3 is opened.

EFFECTS

As described above, in the embodiment, the image forming device 1 sets the development devices 32 to the contact state and performs the cleaning operation and the toner checking operation concurrently, in the warming-up operation, when it is presumed that there is a small amount of toner adhering onto the photoconductive drums 8. Meanwhile, when it is presumed that there is a large amount of toner adhering onto the photoconductive drums 8, the image forming device 1 sets the development devices 32 to the separate state and performs the cleaning operation, and thereafter sets the development devices 32 to the contact state and performs the toner checking operation.

Therefore, according to the image forming device 1, it is possible to reduce a risk that waste toner on the photoconductive drums 8 might be mixed into toner in the development devices 32, without taking an unnecessary time for each warming-up operation. Thereby, it is possible to perform the warming-up operation in an efficient and certain manner.

Further, according to the image forming device 1 of the embodiment, since the status flag is set in the cover monitoring process when the top cover 3 is opened, the warming-up operation is performed in the second warming-up mode in the warming-up process. Thus, it is possible to reduce a risk that contamination such as dust adhering onto the photoconductive drums 8 might be mixed with toner in the development devices 32 when the top cover 3 is opened.

Further, the image forming device 1 of the embodiment performs the cleaning operation each time printing image data based on a print request in the image forming process. Thus, it is possible to prevent the OPC cleaners 38 from holding a large amount of toner. Thereby, it is possible to prevent a large amount of toner from returning onto the photoconductive drums 8 from the OPC cleaners 38 in the warming-up operation, and to reduce, in a preferred manner, the risk that waste toner on the photoconductive drums 8 might be mixed with toner in the development devices 32.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

In the cover monitoring process of the aforementioned embodiment, when the top cover 3 is opened, the status flag is set. However, the status flag may be set when the top cover 3 is further opened relative to a predetermined position, or the top cover 3 is fully opened, depending on an opened (closed) state of the top cover 3.

In the warming-up operation of the aforementioned embodiment, the operational mode for the warming-up operation is determined based on whether the status flag is set in the flag memory area on the RAM 73. However, the operational mode for the warming-up operation may be determined based on the amount of toner adhering onto the photoconductive drums 8 that is estimated based on the detection result of each toner sensor 64.

In the aforementioned embodiment, each photoconductive drum 8 is disposed to contact the conveying belt 23. However, each photoconductive drum 8 may be disposed to at least face the conveying belt 23.

What is claimed is:

1. An image forming device comprising:

an image forming unit that comprises:

a conveying belt;

an image holding body disposed to face the conveying belt;

a development unit configured to be set in a contact state where the development unit contacts the image holding body and a separate state where the development unit is apart from the image holding body; and a transfer unit disposed to contact the conveying belt so as to face the image holding body across the conveying belt, the transfer unit being configured to transfer, onto the conveying belt, development agent held on the image holding body;

a cleaner configured to perform cleaning to remove the development agent that is transferred from the image holding body onto the conveying belt;

a remaining amount detector configured to, in the contact state where the development unit contacts the image holding body, perform detection of an amount of development agent remaining in the development unit;

a status identifying unit including a memory configured to store a status flag set thereon, the status identifying unit being configured to identify a status of development agent on the image holding body, the status including a first status where the status flag is cleared from the memory and a second status where the status flag is set on the memory; and a controller configured to start printing after setting the status flag on the memory, configured to clear the status flag from the memory after completing the printing, and the controller configured to control the cleaner and the remaining amount detector during a warming-up operation performed before an image forming operation by the image forming unit, wherein when the status identifying unit identifies the status of development agent on the image holding body as the first status, the controller controls the remaining amount detector to perform the detection during the cleaning by the cleaner, and wherein when the status identifying unit identifies the status of development agent on the image holding body as the second status, the controller controls the remaining amount detector to perform the detection after execution of the cleaning by the cleaner in the separate state where the development unit is apart from the image holding body.

2. The image forming device according to claim 1, further comprising a storage unit configured to store status information that is set in association with one of the first status and the second status, wherein when the cleaning by the cleaner is completed, the status identifying unit stores the status information set in association with the first status, wherein when one of the image forming operation by the image forming unit, the cleaning by the cleaner, and the detection by the remaining amount detector is forcibly terminated due to an error, the status identifying unit stores the status information set in association with the second status, and wherein the controller is configured to control the cleaner and the remaining amount detector during the warming-up operation with reference to the status information stored in the storage unit.

3. The image forming device according to claim 1, further comprising a collecting unit configured to collect development agent remaining on the image holding body and return the collected development agent onto the image holding body at a predetermined moment, wherein the cleaner is configured to remove development agent containing development agent that is returned onto the image holding body by the collecting unit and transferred by the transfer unit from the image holding body onto the conveying belt.

4. The image forming device according to claim 1, wherein the development unit comprises:

an agitator configured to agitate development agent in the development unit; and two optically-transparent detection windows configured to be used when the remaining amount detector performs the detection, wherein the remaining amount detector comprises:

a light emitter configured to, in the contact state where the development unit contacts the image holding body, emit detection light toward one of the detection windows; and a light receiver configured to receive the detection light emitted by the light emitter and transmitted through the detection windows, and wherein the remaining amount detector is configured to perform the detection based on a frequency at which the light receiver receives the detection light.

5. The image forming device according to claim 4, wherein the development unit comprises a development roller configured to, in the contact state where the development unit contacts the image holding body, rotate in conjunction with the image holding body, wherein the image holding body is disposed to contact the conveying belt and configured to rotate in conjunction with the conveying belt, and wherein the agitator is configured to rotate in conjunction with the development roller.

* * * * *